US007441404B2

(12) United States Patent
Devier et al.

(10) Patent No.: US 7,441,404 B2
(45) Date of Patent: Oct. 28, 2008

(54) CONFIGURABLE HYDRAULIC CONTROL SYSTEM

(75) Inventors: Lonnie James Devier, Channahon, IL (US); Shoji Tozawa, Kobe (JP); Stephen V. Lunzman, Chillicothe, IL (US)

(73) Assignees: Caterpillar Inc., Peoria, IL (US); Shin Caterpillar Mitsubishi Ltd (JP)

( * ) Notice: Subject to any disclaimer, the term of this patent is extended or adjusted under 35 U.S.C. 154(b) by 22 days.

(21) Appl. No.: 10/998,592

(22) Filed: Nov. 30, 2004

(65) Prior Publication Data

US 2006/0112685 A1 Jun. 1, 2006

(51) Int. Cl.
*F16D 31/02* (2006.01)

(52) U.S. Cl. ..... 60/368; 60/422

(58) Field of Classification Search ..... 60/368, 60/398, 422

See application file for complete search history.

(56) References Cited

U.S. PATENT DOCUMENTS

| | | | |
|---|---|---|---|
| 3,366,202 | A | 1/1968 | James |
| 4,046,270 | A | 9/1977 | Baron et al. |
| 4,222,409 | A | 9/1980 | Budzich |
| 4,250,794 | A | 2/1981 | Haak et al. |
| 4,416,187 | A | 11/1983 | Nyström Per H. G. |
| 4,437,385 | A | 3/1984 | Kramer et al. |
| 4,480,527 | A | 11/1984 | Lonnemo |
| 4,581,893 | A | 4/1986 | Lindbom |
| 4,586,330 | A | 5/1986 | Watanabe et al. |
| 4,623,118 | A | 11/1986 | Kumar |
| 4,662,601 | A | 5/1987 | Andersson |
| 4,706,932 | A | 11/1987 | Yoshida et al. |
| 4,747,335 | A | 5/1988 | Budzich |
| 4,799,420 | A | 1/1989 | Budzich |
| 5,152,142 | A | 10/1992 | Budzich |
| 5,211,196 | A | 5/1993 | Schwelm |
| 5,249,421 | A | 10/1993 | Lunzman |
| 5,267,441 | A | 12/1993 | Devier et al. |
| 5,287,794 | A | 2/1994 | Andersson |
| 5,297,381 | A | 3/1994 | Eich et al. |
| 5,305,681 | A | 4/1994 | Devier et al. |
| 5,313,873 | A | 5/1994 | Gall et al. |
| 5,350,152 | A | 9/1994 | Hutchison et al. |

(Continued)

FOREIGN PATENT DOCUMENTS

| | | | |
|---|---|---|---|
| EP | 0967400 | B1 | 12/1999 |

(Continued)

*Primary Examiner*—F. Daniel Lopez
(74) *Attorney, Agent, or Firm*—Finnegan, Henderson, Farabow, Garrett & Dunner

(57) ABSTRACT

A control system for a work machine having a plurality of removably attachable work tools is disclosed. The control system has a tool recognition device configured to generate a recognition signal corresponding to each of the removably attachable work tools, and at least one fluid actuator configured to move at least one of the plurality of removably attachable work tools. The control system also has at least one fluid sensor configured to generate a load signal and at least one operator interface device configured to generate a desired velocity signal. The control system further has a controller in communication with the tool recognition device, the at least one fluid actuator, the at least one fluid sensor, and the at least one input device. The controller is configured to command a velocity for the fluid actuator in response to the recognition signal, the load signal, and the desired velocity signal.

22 Claims, 3 Drawing Sheets

U.S. PATENT DOCUMENTS 5,366,202 A 11/1994 Lunzman
5,477,677 A 12/1995 Krnavek
5,537,818 A 7/1996 Hosseini et al.
5,540,049 A 7/1996 Lunzman
5,553,452 A 9/1996 Snow et al.
5,568,759 A 10/1996 Aardema
5,678,470 A 10/1997 Koehler et al.
5,692,376 A 12/1997 Miki et al.
5,737,993 A 4/1998 Cobo et al.
5,784,945 A 7/1998 Krone et al.
5,813,226 A 9/1998 Krone et al.
5,868,059 A 2/1999 Smith
5,947,140 A 9/1999 Aardema et al.
5,953,977 A 9/1999 Krishna et al.
5,960,695 A 10/1999 Aardema et al.
6,009,708 A 1/2000 Miki et al.
6,061,617 A * 5/2000 Berger et al. ..... 701/50
6,185,493 B1 2/2001 Skinner et al.
6,216,456 B1 4/2001 Mitchell
6,257,118 B1 7/2001 Wilbur et al.
6,446,433 B1 9/2002 Holt et al.
6,467,264 B1 10/2002 Stephenson et al.
6,502,393 B1 1/2003 Stephenson et al.
6,502,500 B2 1/2003 Yoshino
6,542,789 B2 * 4/2003 Ufheil ..... 701/50
6,598,391 B2 7/2003 Lunzman et al.
6,619,183 B2 9/2003 Yoshino
6,655,136 B2 12/2003 Holt et al.
6,662,705 B2 12/2003 Huang et al.
6,691,603 B2 2/2004 Linerode et al.
6,694,860 B2 2/2004 Yoshino
6,715,402 B2 4/2004 Pfaff et al.
6,718,759 B1 4/2004 Tabor
6,725,131 B2 4/2004 Lunzman
6,732,512 B2 5/2004 Pfaff et al.
6,748,738 B2 6/2004 Smith
6,761,029 B2 7/2004 Linerode
2003/0121256 A1 7/2003 Mather
2004/0055288 A1 3/2004 Pfaff et al.
2004/0055289 A1 3/2004 Pfaff et al.
2004/0055452 A1 3/2004 Tabor
2004/0055453 A1 3/2004 Tabor
2004/0055454 A1 3/2004 Pfaff et al.
2004/0055455 A1 3/2004 Tabor et al.

FOREIGN PATENT DOCUMENTS

JP 2613041 5/1997

* cited by examiner

CONFIGURABLE HYDRAULIC CONTROL SYSTEM

TECHNICAL FIELD

The present disclosure relates generally to a hydraulic control system, and more particularly, to a configurable hydraulic control system.

BACKGROUND

Work machines such as, for example, excavators, loaders, dozers, motor graders, and other types of heavy machinery use multiple hydraulic actuators to accomplish a variety of tasks. These actuators are typically velocity controlled based on an actuation position of an operator interface device. For example, an operator interface device such as a joystick, a pedal, or any other suitable operator interface device may be movable to generate a signal indicative of a desired velocity of an associated hydraulic actuator. When an operator moves the interface device, the operator expects the hydraulic actuator to move at an associated predetermined velocity. However, this predetermined velocity is set during manufacture of the work machine, generally without a load being applied to the hydraulic actuator. During operation of the work machine when a load applied against the hydraulic actuator is light, the hydraulic actuator may move at a velocity that substantially matches the operator's expected velocity. However, when the load applied against the hydraulic actuator is heavy, the hydraulic actuator may move at slower and unexpected or undesired velocity. Attempts to control the velocity of the hydraulic actuator regardless of loading have resulted in harsh or jerky movements of the hydraulic actuator.

One method of improving the predictability of hydraulic actuator velocity while providing smooth operation of the hydraulic actuator is described in U.S. Pat. No. 5,784,945 (the '945 patent) issued to Krone et al. on Jul. 28, 1998. The '945 patent describes an apparatus for determining a valve transform curve in a work machine fluid system. The fluid system includes a fluid actuator with a valve arranged to initiate movement of a load. A desired velocity is determined from a load control input device and a characteristic of an applied load (a weight or a position) is determined. A valve transform curve is then generated to achieve the desired velocity based on the characteristic of the applied load.

Although the apparatus of the '945 patent may improve velocity predictability of the fluid actuator under several classifications of loads, the apparatus of the '945 patent does not provide flexibility when operating different work tools attachable to the same work machine or when different operators are controlling the work machine. For example, one work tool may function optimally under a different input device position/load/command velocity relationship than another work tool attachable to the same work machine. Further, one work machine operator may expect or prefer a different input device position/load/command velocity relationship than another work machine operator. The apparatus of the '945 patent does not allow the input device position/load/command velocity relationship to be modified or selected for different work tool attachment configurations or according to operator preference.

The disclosed hydraulic control system is directed to overcoming one or more of the problems set forth above.

SUMMARY OF THE INVENTION

In one aspect, the present disclosure is directed to a hydraulic control system for a work machine having a plurality of removably attachable work tools. The control system includes a tool recognition device configured to generate a recognition signal corresponding to each of the removably attachable work tools, and at least one fluid actuator configured to move at least one of the plurality of removably attachable work tools. The control system also includes at least one fluid sensor configured to generate a load signal and at least one operator interface device configured to generate a desired velocity signal. The control system further includes a controller in communication with the tool recognition device, the at least one fluid actuator, the at least one fluid sensor, and the at least one input device. The controller is configured to command a fluid actuator velocity in response to the recognition signal, the load signal, and the desired velocity signal.

In another aspect, the present disclosure is directed to a method of operating a work machine having a plurality of removably attachable work tools. The method includes receiving an input indicative of a desired velocity of at least one fluid actuator associated with at least one of the plurality of removably attachable work tools and generating a desired velocity signal. The method also includes generating a recognition signal indicative of which one of the plurality of removably attachable work tools is attached to the work machine. The method further includes sensing a load on the at least one fluid actuator and generating a load signal. The method additionally includes commanding a fluid actuator velocity in response to the desired velocity signal, the recognition signal, and the load signal.

DETAILED DESCRIPTION

Figure 1:
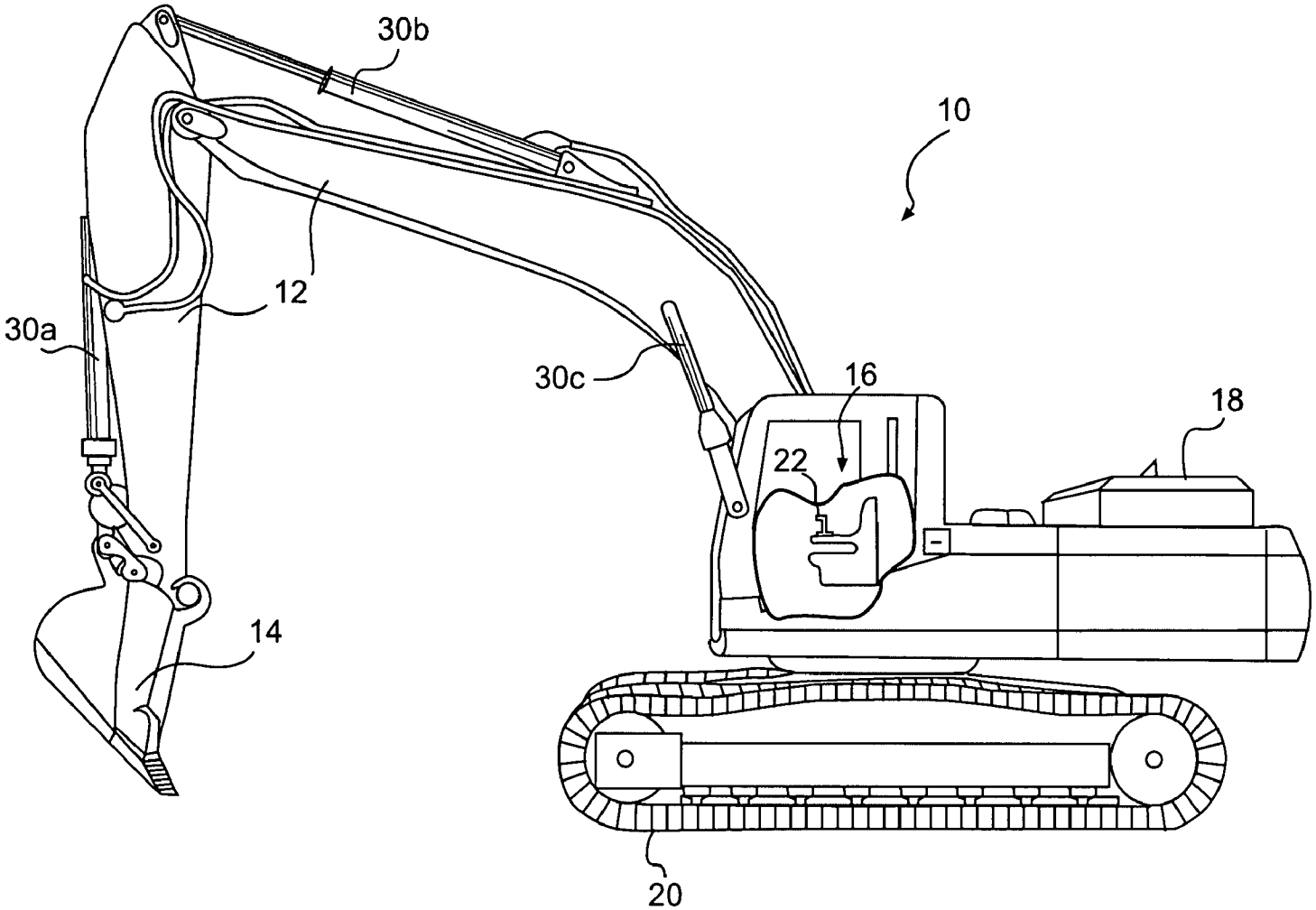
FIG. 1 is a side-view diagrammatic illustration of an exemplary disclosed work machine.

FIG. 1 illustrates an exemplary work machine 10. Work machine 10 may be a fixed or mobile machine that performs some type of operation associated with an industry such as mining, construction, farming, transportation, or any other industry known in the art. For example, work machine 10 may be an earth moving machine such as an excavator, a dozer, a loader, a backhoe, a motor grader, a dump truck, or any other earth moving machine. Work machine 10 may include a frame 12, a work tool 14 removably attachable to work machine 10, one or more hydraulic actuators 30*a-c* connecting work implement 14 to frame 12, an operator interface 16, a power source 18, and at least one traction device 20.

Frame 12 may include any structural unit that supports movement of work machine 10. Frame 12 may embody, for example, a stationary base frame connecting power source 18 to traction device 20, a movable frame member of a linkage system, or any other frame known in the art.

Numerous different work tools 14 may be attachable to a single work machine and controllable via operator interface 16. Work tool 14 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Work tool 14 may be connected to work machine 10 via a direct pivot, via a linkage system, via one or more hydraulic cylinders, via a motor, or in any other appropriate manner. Work tool 14 may be configured to pivot, rotate, slide, swing, lift, or move relative to work machine 10 in any manner known in the art.

Operator interface 16 may be configured to receive input from a work machine operator indicative of a desired work tool movement. Specifically, operator interface 16 may include an operator interface device 22 embodies a multi-axis joystick located to one side of an operator station. Operator interface device 22 may be a proportional-type controller configured to position and/or orient work tool 14 and to produce an interface device position signal indicative of a desired velocity of work tool 14. It is contemplated that additional and/or different operator interface devices may be included within operator interface 16 such as, for example, wheels, knobs, push-pull devices, switches, pedals, and other operator interface devices known in the art.

Power source 18 may be an engine such as, for example, a diesel engine, a gasoline engine, a natural gas engine, or any other engine known in the art. It is contemplated that power source 18 may alternately be another source of power such as a fuel cell, a power storage device, an electric or hydraulic motor, or another source of power known in the art.

Traction device 20 may include tracks located on each side of work machine 10 (only one side shown). Alternately, traction device 20 may include wheels, belts, or other traction devices. Traction device 20 may or may not be steerable. It contemplated that traction device 20 may be hydraulically controlled, mechanically controlled, electronically controlled, or controlled in any other suitable manner.

Figure 2:
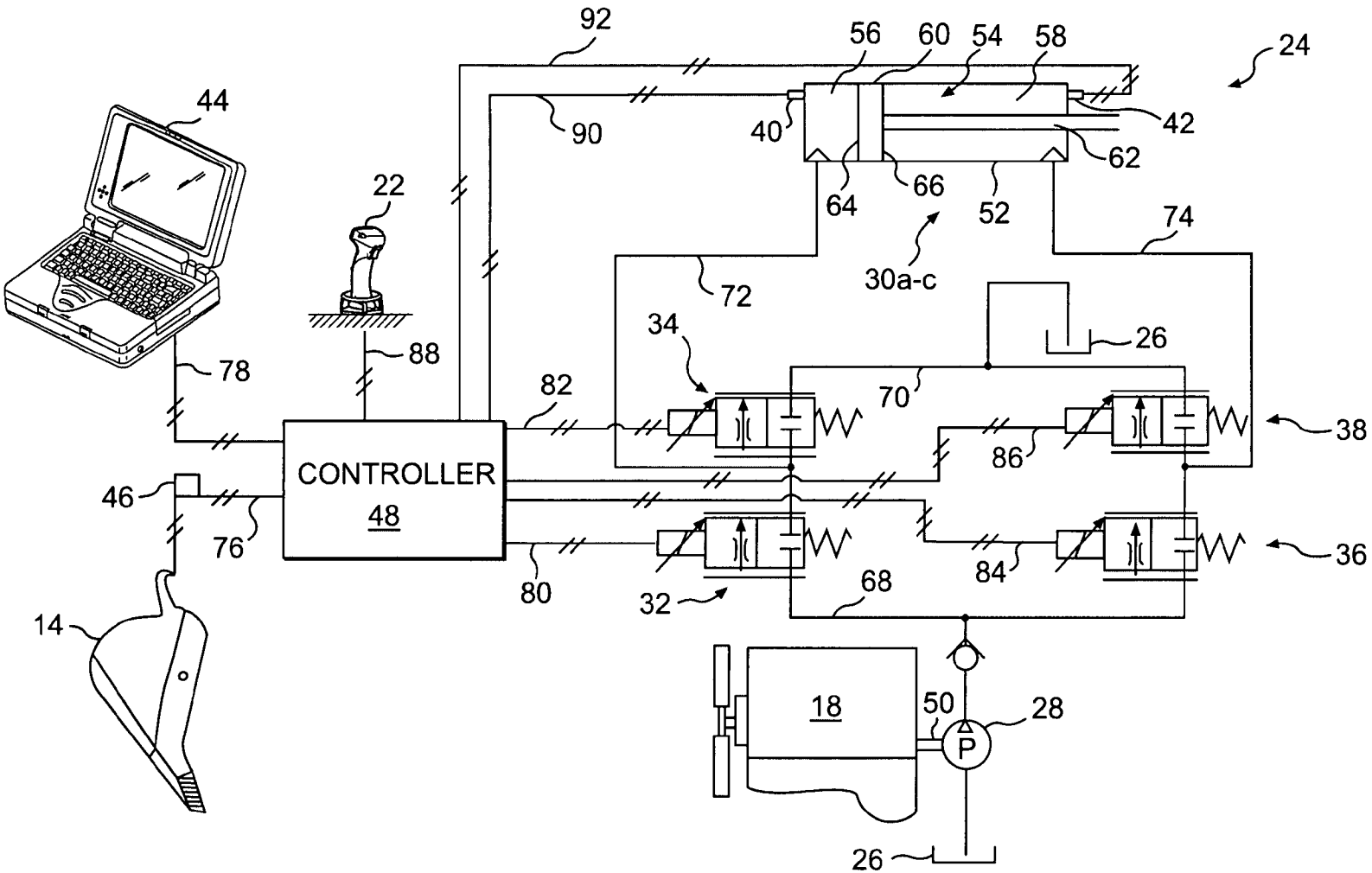
FIG. 2 is a schematic illustration of an exemplary disclosed hydraulic control system for the work machine of FIG. 1.

As illustrated in FIG. 2, work machine 10 may include a hydraulic control system 24 having a plurality of fluid components that cooperate together to move work tool 14. Specifically, hydraulic control system 24 may include a tank 26 holding a supply of fluid, and a source 28 configured to pressurize the fluid and to direct the pressurized fluid to hydraulic actuators 30*a-c*. While FIG. 1 depicts three actuators, identified as 30*a*, 30*b*, and 30*c*, for the purposes of simplicity, the hydraulic schematic of FIG. 2 depicts only one cylinder. Hydraulic control system 24 may also include a head-end supply valve 32, a head-end drain valve 34, a rod-end supply valve 36, a rod-end drain valve 38, a head-end pressure sensor 40, a rod-end pressure sensor 42, a manual input device 44, and a tool recognition device 46. Hydraulic control system 24 may further include a controller 48 in communication with the fluid components of hydraulic control system 24, manual input device 44, and tool recognition device 46. It is contemplated that hydraulic control system 24 may include additional and/or different components such as, for example, accumulators, restrictive orifices, check valves, pressure relief valves, makeup valves, pressure-balancing passageways, temperature sensors, position sensors, and other components known in the art. It is also contemplated that, instead of being separate independent valves, head and rod-end supply and drain valves 32-38 may alternately be embodied in one or more valve mechanisms performing both supply and drain valve functions.

Tank 26 may constitute a reservoir configured to hold a supply of fluid. The fluid may include, for example, a dedicated hydraulic oil, an engine lubrication oil, a transmission lubrication oil, or any other fluid known in the art. One or more hydraulic systems within work machine 10 may draw fluid from and return fluid to tank 26. It is also contemplated that hydraulic control system 24 may be connected to multiple separate fluid tanks.

Source 28 may be configured to produce a flow of pressurized fluid and may include a pump such as, for example, a variable displacement pump, a fixed displacement pump, or any other source of pressurized fluid known in the art. Source 28 may be drivably connected to power source 18 of work machine 10 by, for example, a countershaft 50, a belt (not shown), an electrical circuit (not shown), or in any other suitable manner. Alternately, source 28 may be indirectly connected to power source 18 via a torque converter, a gear box, or in any other manner known in the art. It is contemplated that multiple sources of pressurized fluid may be interconnected to supply pressurized fluid to hydraulic control system 24.

Hydraulic actuators 30*a-c* may include fluid cylinders that connect work tool 14 to frame 12 via a direct pivot, via a linkage system with hydraulic actuators 30*a-c* forming members in the linkage system (referring to FIG. 1), or in any other appropriate manner. It is contemplated that hydraulic actuators other than fluid cylinders may alternately be implemented within hydraulic control system 24 such as, for example, hydraulic motors or any other hydraulic actuator known in the art. As illustrated in FIG. 2, each of hydraulic actuators 30*a-c* may include a tube 52 and a piston assembly 54 disposed within tube 52. One of tube 52 and piston assembly 54 may be pivotally connected to frame 12, while the other of tube 52 and piston assembly 54 may be pivotally connected to work tool 14. It is contemplated that tube 52 and/or piston assembly 54 may alternately be fixedly connected to either frame 12 or work tool 14. Each of hydraulic actuators 30*a-c* may include a first chamber 56 and a second chamber 58 separated by a piston crown 60. First and second chambers 56, 58 may be selectively supplied with pressurized fluid from source 28 and selectively connected with tank 26 to cause piston assembly 54 to displace within tube 52, thereby changing the effective length of hydraulic actuators 30*a-c*. The expansion and retraction of hydraulic actuators 30*a-c* may function to assist in moving work tool 14.

Piston assembly 54 may include piston crown 60 being axially aligned with and disposed within tube 52, and a piston rod 62 connectable to one of frame 12 and work tool 14 (referring to FIG. 1). Piston crown 60 may include a first hydraulic surface 64 and a second hydraulic surface 66 opposite first hydraulic surface 64. An imbalance of force caused by fluid pressure on first and second hydraulic surfaces 64, 66 may result in movement of piston assembly 54 within tube 52. For example, a force on first hydraulic surface 64 being greater than a force on second hydraulic surface 66 may cause piston assembly 54 to displace to increase the effective length of hydraulic actuators 30*a-c*. Similarly, when a force on second hydraulic surface 66 is greater than a force on first hydraulic surface 64, piston assembly 54 will retract within tube 52 to decrease the effective length of hydraulic actuators 30*a-c*. A flow rate of fluid into and out of first and second chambers 56 and 58 may determine a velocity of hydraulic actuators 30*a-c*, while a pressure of the fluid in contact with first and second hydraulic surfaces 64 and 66 may determine an actuation force of hydraulic actuators 30*a-c*. A sealing member (not shown), such as an o-ring, may be connected to piston crown 60 to restrict a flow of fluid between an internal wall of tube 52 and an outer cylindrical surface of piston crown 60.

Head-end supply valve 32 may be disposed between source 28 and first chamber 56 and configured to regulate a flow of pressurized fluid to first chamber 56 in response to a command velocity from controller 48. Specifically, head-end supply valve 32 may include a proportional spring biased valve mechanism that is solenoid actuated and configured to move between a first position at which fluid is allowed to flow into first chamber 56 and a second position at which fluid flow is blocked from first chamber 56. Head-end supply valve 32 may be movable to any position between the first and second positions to vary the rate of flow into first chamber 56, thereby affecting the velocity of hydraulic actuators 30*a-c*. It is contemplated that head-end supply valve 32 may alternately be hydraulically actuated, mechanically actuated, pneumatically actuated, or actuated in any other suitable manner. It is further contemplated that head-end supply valve 32 may be configured to allow fluid from first chamber 56 to flow through head-end supply valve 32 during a regeneration event when a pressure within first chamber 56 exceeds a pressure directed to head-end supply valve 32 from source 28.

Head-end drain valve 34 may be disposed between first chamber 56 and tank 26 and configured to regulate a flow of fluid from first chamber 56 to tank 26 in response to the command velocity from controller 48. Specifically, head-end drain valve 34 may include a proportional spring biased valve mechanism that is solenoid actuated and configured to move between a first position at which fluid is allowed to flow from first chamber 56 and a second position at which fluid is blocked from flowing from first chamber 56. Head-end drain valve 34 may be movable to any position between the first and second positions to vary the rate of flow from first chamber 56, thereby affecting the velocity of hydraulic actuators 30*a-c*. It is contemplated that head-end drain valve 34 may alternately be hydraulically actuated, mechanically actuated, pneumatically actuated, or actuated in any other suitable manner.

Rod-end supply valve 36 may be disposed between source 28 and second chamber 58 and configured to regulate a flow of pressurized fluid to second chamber 58 in response to the command velocity from controller 48. Specifically, rod-end supply valve 36 may include a proportional spring biased valve mechanism that is solenoid actuated and configured to move between a first position at which fluid is allowed to flow into second chamber 58 and a second position at which fluid is blocked from second chamber 58. Rod-end supply valve 36 may be movable to any position between the first and second positions to vary the rate of flow into second chamber 58, thereby affecting the velocity of hydraulic actuators 30*a-c*. It is contemplated that rod-end supply valve 36 may alternately be hydraulically actuated, mechanically actuated, pneumatically actuated, or actuated in any other suitable manner. It is further contemplated that rod-end supply valve 36 may be configured to allow fluid from second chamber 58 to flow through rod-end supply valve 36 during a regeneration event when a pressure within second chamber 58 exceeds a pressure directed to rod-end supply valve 36 from source 28.

Rod-end drain valve 38 may be disposed between second chamber 58 and tank 26 and configured to regulate a flow of fluid from second chamber 58 to tank 26 in response to a command velocity from controller 48. Specifically, rod-end drain valve 38 may include a proportional spring biased valve mechanism that is solenoid actuated and configured to move between a first position at which fluid is allowed to flow from second chamber 58 and a second position at which fluid is blocked from flowing from second chamber 58. Rod-end drain valve 38 may be movable to any position between the first and second positions to vary the rate of flow from second chamber 58, thereby affecting the velocity of hydraulic actuators 30*a-c*. It is contemplated that rod-end drain valve 38 may alternately be hydraulically actuated, mechanically actuated, pneumatically actuated, or actuated in any other suitable manner.

Head and rod-end supply and drain valves 32-38 may be fluidly interconnected. In particular, head and rod-end supply valves 32, 36 may be connected in parallel to a common supply passageway 68 extending from source 28. Head and rod-end drain valves 34, 38 may be connected in parallel to a common drain passageway 70 leading to tank 26. Head-end supply and drain valves 32, 34 may be connected in parallel to a first chamber passageway 72 for selectively supplying and draining first chamber 56 in response to the command velocity from controller 48. Rod-end supply and drain valves 36, 38 may be connected in parallel to a common second chamber passageway 74 for selectively supplying and draining second chamber 58 in response to the command velocity from controller 48.

Head and rod-end pressure sensors 40, 42 may be in fluid communication with first and second chambers 56, 58, respectively and configured to sense the pressure of the fluid within first and second chambers 56, 58. Head and rod-end pressure sensors 40, 42 may be further configured to generate a hydraulic actuator load signal indicative of the pressures within first and second chambers 56, 58.

Tool recognition device 46 may be configured to automatically generate a recognition signal indicative of which work tool 14 is currently attached to work machine 10 and to direct that recognition signal to controller 48. Specifically, tool recognition device 46 may be in communication via communication line 76 with controller 48. Tool recognition device 46 may include a scanning device such as, for example, an optical scanner, a laser scanner, a magnetic scanner or any other appropriate scanner that is configured to recognize a unique identification code associated with each work tool 14. It is contemplated that the tool identification code could alternately be incorporated into a plug and socket arrangement, wherein a pin pattern may be unique to a specific work tool and serve to identify that particular work tool. It is further contemplated that other means for automatically identifying a particular work tool may be implemented such as, for example, a switch configured to receive an encoded key having magnetic information or a memory chip, an RF telemetry system, or any other means known in the art. It is also contemplated that the unique identification code may alternately be manually entered by an operator during attachment of work tool 14.

The identification code, for the purposes of the present disclosure, may include a configuration of letters, numbers, symbols, pulses, voltage levels, bar codes or other indicia, signals, magnetic fields, sound or light waves, and other configurations that may represent a specific work tool. The identification code may take the form of either or both of human readable information and machine readable information. The identification code may be attached to work tool 14 and located so as to be automatically read by tool recognition device 46 when work tool 14 is attached to work machine 10.

Manual input device 44 may include a means for receiving velocity performance information for hydraulic actuators 30*a-c* entered by an operator of work machine 10. This means for receiving velocity performance information may include, for example, a keypad allowing the velocity information to be manually entered by an operator, a switch configured to receive an encoded key having magnetic information or a memory chip, a data port allowing communication with a service tool or a computer having the velocity performance information, an antenna allowing reception of the velocity performance information from a remote location, a scanner configured to read an encoded indicia having the velocity information, or any other configuration that can receive the velocity performance information. It is further contemplated that the velocity performance information may be selected from an on-screen menu of a work machine display system. The velocity performance information received via manual input device 44 may correspond to a particular operator's preference for how hydraulic actuators 30*a-c* perform under varying loads. In particular, one operator may prefer a first relationship between interface device position, load, and commanded velocity of hydraulic actuators 30*a-c*, while a second operator may prefer a second relationship that is different from the first relationship. Manual input device 44 may be in communication with controller 48 via a communication line 78.

Controller 48 may embody a single microprocessor or multiple microprocessors that include a means for controlling an operation of hydraulic control system 24. Numerous commercially available microprocessors can be configured to perform the functions of controller 48. It should be appreciated that controller 48 could readily be embodied in a general work machine microprocessor capable of controlling numerous work machine functions. Controller 48 may include a memory, a secondary storage device, a processor, and any other components for running an application. Various other circuits may be associated with controller 48 such as power supply circuitry, signal conditioning circuitry, solenoid driver circuitry, and other types of circuitry.

Figure 3:
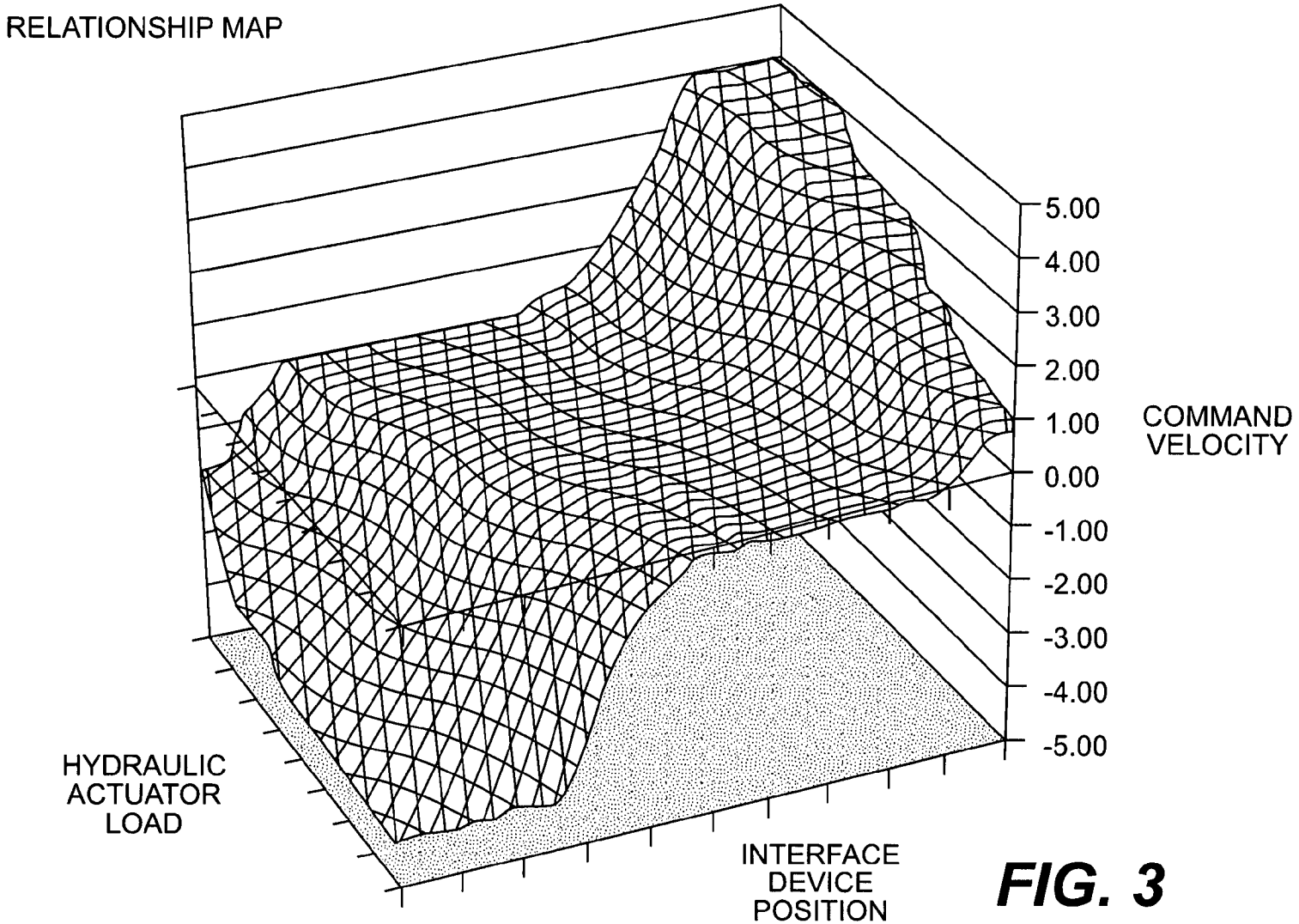
FIG. 3 is a pictorial illustration of an exemplary disclosed map relating operator interface device position, hydraulic cylinder load, and command velocity.

One or more maps relating interface device position, fluid actuator load, and command velocity information for hydraulic actuators 30*a-c* may be stored in the memory of controller 48. Each of these maps may be in the form of a 3-D table. As illustrated in the exemplary relationship map of FIG. 3, interface device position, hydraulic actuator load, and command velocity may form the three coordinate axis of the table. It is also contemplated that interface device position, fluid actuator load, and command velocity information may alternatively be contained on separate related 2-D tables or in one or more equations stored in the memory of controller 48. Controller 48 may be configured to allow the operator to directly modify the interface device position/load/command velocity relationship maps via manual input device 44 and/or to select specific maps from available relationship maps stored in the memory of controller 48 to affect actuation of hydraulic actuators 30*a-c*. It is contemplated that the maps may be selectable for various applications in which machine 10 is used such as, for example, a first map optimized for digging, a second map for leveling, a third map for pipe-laying, and other such machine applications. The relationship maps may alternately be automatically selected and/or modified by controller 48 in response to the recognition signal from tool recognition device 46 to affect actuation of hydraulic actuators 30*a-c*.

Controller 48 may be configured to receive input from operator interface device 22 and head and rod-end pressure sensors 40, 42, and to command a velocity for hydraulic actuators 30*a-c* in response to the input and the relationship map selected and/or modified via tool recognition device 46 and/or manual input device 44. Specifically, controller 48 may be in communication with head and rod-end supply and drain valves 32-38 of hydraulic actuators 30*a-c* via communication lines 80-86 respectively, with operator interface device 22 via a communication line 88, and with head and rod-end pressure sensors 40, 42 via communication lines 90 and 92, respectively. Controller 48 may receive the interface device position signal from operator interface device 22, the hydraulic actuator load signals from head and rod-end pressure sensors 40, 42, and reference the selected and/or modified relationship maps stored in the memory of controller 48 to determine command velocity values. These velocity values may then be commanded of hydraulic actuators 30*a-c* causing head-end and rod-end supply and drain valves 32-38 to selectively fill or drain first and second chambers 56, 58 associated with hydraulic actuators 30*a-c* to produce the desired work tool velocity.

INDUSTRIAL APPLICABILITY

The disclosed hydraulic control system may be applicable to any work machine that includes a hydraulic actuator where velocity predictability under varying loads and operational situations is desired. The disclosed hydraulic control system may improve operator control by relating hydraulic actuator loading and a position of an operator interface device to a velocity commanded of the hydraulic actuator. Further, the disclosed hydraulic control system may provide flexibility by allowing the relationship between hydraulic actuator loading, operator interface device position, and the commanded velocity to be modified and or selected according to work tool attachment configuration and/or operator preference. This improved flexibility may facilitate an increase in production and efficiency of the work machine. The operation of hydraulic control system 24 will now be explained.

During operation of work machine 10, a work machine operator may manipulate operator interface device 22 to create a movement of work tool 14. The actuation position of operator interface device 22 may be related to an operator expected or desired velocity of work tool 14. Operator interface device 22 may generate a position signal indicative of the operator expected or desired velocity during operator manipulation and send this position signal to controller 48.

Controller 48 may be configured to determine a command velocity for hydraulic actuators 30*a-c* that results in the operator expected or desired velocity under varying loading conditions. Specifically, controller 48 may be configured to receive the operator interface device position signal, to receive the load signal from head and rod-end pressure sensors 40, 42, and to compare the operator interface device position signal and the load signal to the relationship map stored in the memory of controller 48 to determine an appropriate velocity command signal. Controller 48 may then send the command signal to head and rod-end supply and drain valves 32-38 to regulate the flow of pressurized fluid into and out of first and second chambers 56, 58, thereby causing movement of hydraulic actuators 30*a-c* that substantially matches the operator expected or desired velocity.

The relationship maps referenced by controller 48 to determine the command velocity for hydraulic actuators 30*a-c* may be modified and/or selected from a plurality of available maps. In particular, controller 48 may be configured to receive the recognition signal from tool recognition device 46 indicative of which of the removably attachable work tools 14 are currently attached to work machine 10 and to reference a particular one of the available relationship maps and/or to modify a particular one of the available maps prior to determining the command velocity. Further, controller 48 may allow an operator to manually select and/or modify a particular one of the available maps prior to determining the command velocity.

It will be apparent to those skilled in the art that various modifications and variations can be made to the disclosed hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic control system for a machine having a plurality of removably attachable tools, comprising:

a tool recognition device configured to generate a recognition signal corresponding to each of the removably attachable tools;

at least one fluid actuator configured to move at least one of the plurality of removably attachable tools;

at least one fluid sensor configured to generate a load signal indicative of a load on the at least one fluid actuator;

at least one operator interface device configured to generate a desired velocity signal indicative of a desired velocity of the fluid actuator;

a controller in communication with the tool recognition device, the at least one fluid actuator, the at least one fluid sensor, and the at least one operator interface device, the controller configured to command a velocity for the fluid actuator in response to the recognition signal, the load signal, and the desired velocity signal; and wherein the controller includes a memory having at least one table stored therein, the table functionally relating a plurality of operator interface device position values and a plurality of fluid actuator load values to establish command velocity.

2. The hydraulic control system of claim 1, further including at least one valve mechanism movable in response to the commanded velocity to selectively communicate a pressurized fluid with the fluid actuator.

3. The hydraulic control system of claim 1, wherein the tool recognition device includes a scanner disposed on the machine and configured to automatically recognize which of the plurality of removably attachable tools are attached to the machine and to generate the recognition signal in response to the recognition.

4. The hydraulic control system of claim 1, wherein the tool recognition device is configured to receive a manual input corresponding to which of the plurality of removably attachable tools are attached to the machine and to generate the recognition signal in response to the input.

5. The tool recognition device of claim 1, wherein the at least one table is modifiable in response to the recognition signal.

6. The hydraulic control system of claim 1, wherein the at least one table includes a plurality of tables, each of the plurality of tables corresponding to a different one of the plurality of removably attachable machine tools.

7. The tool recognition device of claim 1, wherein the recognition signal is unique for each of the plurality of removably attachable tools.

8. A method of operating a machine having a plurality of removably attachable tools, the method comprising:

receiving an input indicative of a desired velocity of at least one fluid actuator associated with at least one of the plurality of removably attachable tools and generating a desired velocity signal;

generating a recognition signal indicative of which one of the plurality of removably attachable tools is attached to the machine;

sensing a load on the at least one fluid actuator and generating a load signal;

commanding a fluid actuator velocity in response to the desired velocity signal, the recognition signal, and the load signal;

referencing at least one table stored in a memory of a machine controller to determine the command velocity, the at least one table relating command velocity, fluid actuator load, and input device position; and wherein the at least one table is modifiable in response to the recognition signal.

9. The method of claim 8, further including automatically recognizing which of the plurality of removably attached tools are attached to the machine and generating the recognition signal in response to the recognition.

10. The method of claim 8, further including receiving a manual input corresponding to which of the plurality of removably attachable tools are attached to the machine and generating the recognition signal in response to the manual input.

11. The method of claim 8, wherein the at least one table includes a plurality of tables, each of the plurality of tables corresponding to a different one of the plurality of removably attachable machine tools.

12. A method of operating a machine having a plurality of removably attachable tools, the method comprising:

sensing a load on the at least one fluid actuator and generating a load signal;

receiving an input device position signal indicative of a desired velocity of at least one fluid actuator associated with at least one of the plurality of removably attachable tools and generating a desired velocity signal;

receiving a manual input indicative of velocity performance information for the at least one fluid actuator;

commanding a fluid actuator velocity in response to the load signal, the desired velocity signal, and the velocity performance information; and referencing at least one table stored in a memory of machine controller to determine the command velocity, wherein command velocity, fluid actuator load, and input device position form three axes of the at least one table.

13. The method of claim 12, further including modifying the at least one table in response to the velocity performance information.

14. The method of claim 12, wherein the at least one table includes a plurality of tables, each of the plurality of tables having a different relationship between input device position, fluid actuator load, and command velocity, and the method further includes selectively implementing one of the plurality of tables in response to the velocity performance information to determine the command velocity.

15. A machine, comprising:

a plurality of removably attachable tools; and a hydraulic control system having:

a tool recognition device configured to generate a recognition signal corresponding to each of the removably attachable tools;

at least one fluid actuator configured to move at least one of the plurality of removably attachable tools;

at least one fluid sensor configured to generate a load signal indicative of a load on the at least one fluid actuator;

at least one operator interface device configured to generate a desired velocity signal indicative of a desired velocity of the fluid actuator;

a manual input device configured to receive velocity performance information for the at least one fluid actuator;

a controller in communication with the at least one fluid actuator, the at least one fluid sensor, the at least one operator interface device, and at least one of the tool recognition device and the manual input device, the controller configured to command a velocity for the fluid actuator in response to the load signal, the desired velocity signal and at least one of the recognition signal and the velocity performance information; and wherein the controller includes a memory having at least one table stored therein, the at least one table is modifiable in response to the recognition signal.

16. The machine of claim 15, further including at least one valve mechanism movable in response to the commanded velocity to selectively communicate a pressurized fluid with the fluid actuator.

17. The machine of claim 15, wherein the tool recognition device includes a scanner disposed on the machine and configured to automatically recognize which of the plurality of removably attachable tools are attached to the machine and to generate the recognition signal in response to the recognition.

18. The machine of claim 15, wherein the tool recognition device is configured to receive a manual input corresponding to which of the plurality of removably attachable tools are attached to the machine and to generate the recognition signal in response to the input.

19. The machine of claim 15, wherein the table includes a relationship between operator interface device position, fluid actuator load, and command velocity.

20. The machine of claim 19, wherein the at least one table includes a plurality of tables, each of the plurality of tables corresponding to a different one of the plurality of removably attachable machine tools.

21. The machine of claim 19, wherein the at least one table is modifiable in response to the velocity performance information.

22. The machine of claim 19, wherein the at least one table includes a plurality of tables, each of the plurality of tables having a different relationship between operator interface device position, fluid actuator load, and command velocity, and being selectively implemented by the controller in response to the velocity performance information to determine the commanded velocity.

* * * * *